United States Patent [19]

Frear

[11] 4,387,944

[45] Jun. 14, 1983

[54] ELECTRICAL CONNECTOR INSERT

[75] Inventor: David L. Frear, Afton, N.Y.

[73] Assignee: The Bendix Corporation, Southfield, Mich.

[21] Appl. No.: 279,149

[22] Filed: Jun. 30, 1981

[51] Int. Cl.[3] ..... H01R 13/42

[52] U.S. Cl. ..... 339/59 R

[58] Field of Search ..... 339/59 R, 59 M, 217 S

[56] References Cited

U.S. PATENT DOCUMENTS

| | | | |
|---|---|---|---|
| 3,158,424 | 11/1964 | Bowen . | |
| 3,165,369 | 1/1965 | Maston . | |
| 3,221,292 | 11/1965 | Swanson et al. . | |
| 3,390,376 | 6/1968 | Nava | 339/217 S |
| 3,747,047 | 7/1973 | Carter et al. | 339/217 S X |
| 3,812,447 | 5/1974 | Eifler et al. | 339/59 R |
| 3,824,681 | 7/1974 | Clark | 339/90 C |
| 4,023,880 | 5/1977 | Powell | 339/63 M X |
| 4,082,398 | 4/1978 | Bourdon et al. | 339/217 S X |

FOREIGN PATENT DOCUMENTS

| | | | |
|---|---|---|---|
| 1790043 | 12/1971 | Fed. Rep. of Germany | 339/59 R |

*Primary Examiner*—Mark Rosenbaum

*Attorney, Agent, or Firm*—Raymond J. Eifler

[57] ABSTRACT

An electrical connector insert that permits front or rear release of the contact within the connector and rear removal of a contact. The invention relates to connectors and more particularly to an electrical connector insert within the connector that retains electrical contacts (50) having a enlarged middle portion (51) and is characterized by a plurality of resiliently and radially expandable tubular contact retention towers (15) each having an internal annular groove (18) that engages the enlarged portion (51) of a respective contact (50) surfaces (16 and 17) on opposite sides of said groove (18) taper radially outwardly away from said groove and are adapted to receive an appropriate tool from the rear or the front of the tower (15) to radially expand the tower (15) whereby a contact (50) is released from either the front or rear of the tower (15) for removal from the rear of the tower.

4 Claims, 4 Drawing Figures

ELECTRICAL CONNECTOR INSERT

This invention relates to electrical connectors and more particularly to an electrical connector insert within the connector that retains the electrical contacts.

Electrical connectors generally include a plug and a receptacle, each of which has an insert of dielectric material provided with multiple openings within which electrical contacts are releasably retained. Examples of electrical connectors that have rear releasable and rear removable contacts may be found in U.S. Pat. Nos. 3,165,369 issued Jan. 12, 1965 and entitled, "Retention System for Electrical Contacts;" 3,158,424 issued November 24, 1964 and entitled, "Contact Mounting;" and 3,824,681 issued July 23, 1974 and entitled, "Method of Providing a Coupling for Electrical Connectors and the Like." Connectors of this type allow contacts to be removed from the rear of a connector while it is still connected to another connector. An example of another type of electrical connector that has front releasable and front removable contacts as well as rear releasable and rear removable contacts may be found in U.S. Pat. No. 4,082,398 issued Apr. 4, 1978 and entitled, "Electrical Connector with Front and Rear Insertable and Removable Contacts." Finally, an example of an electrical connector of the type having front releasable and rear removable contacts may be found in U.S. Pat. No. 3,221,292 issued November 30, 1960 and entitled, "Electrical Connector." This last type of connector makes it easier to identify the contact to be removed since identification of the contacts is located in the front face of the connector.

None of the foregoing connectors provide a connector that permits front or rear release of a contact that can be removed from the rear of the connector.

DISCLOSURE OF THE INVENTION

This invention provides an electrical connector having front or rear releasable and removable contacts.

The invention is an electrical connector having an insert comprising a body of dielectric material having a plurality of passages that are adapted to receive respective electrical contacts therein which are insertable from the rear and which have an enlarged section defining a rearwardly facing shoulder and a forwardly facing shoulder, the connector insert characterized by a plurality of tubular contact retention towers integral with the insert body and coaxial with respective passages therein, each of the towers having an internal annular groove therein the surfaces on opposite sides of the grooves tapering radially outwardly from said groove, each tower being resiliently and radially expandable to permit the enlarged section of a respective contact to pass into the tower upon insertion of the contact into a respective passage from the rear of the insert body, the tower contracting when the enlarged portion of the contact enters the annular groove in the tower, the walls of the groove engaging the forward and rearward shoulders of the enlarged portion of the contact to limit forward and rearward movement of the contact in the passage, the tapered surfaces on both sides of said groove adapted to receive an appropriate tool from the rear or the front of the passage to radially expand the towers whereby the contact being released from either the front or rear of the passage may be removed from the insert body.

One advantage of this invention is that it provides the option of releasing a contact from either the front or the rear of a connector depending on the circumstances involved with removing a contact from the rear of the connector.

Another advantage of this invention is that it provides an electrical connector that combines the advantages of a front release and a rear release connector into one connector having rear removable contacts.

DETAILED DESCRIPTION OF THE INVENTION

Figure 1:
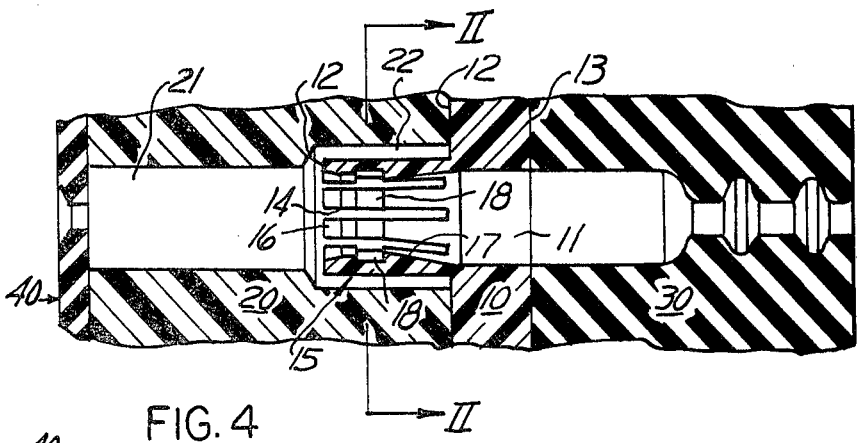
FIG. 1 illustrates a partial view of an electrical connector assembly incorporating the principles of this invention.

Referring now to the drawing, FIG. 1 illustrates a partial view of the components of an electrical connector assembly comprising: an interfacial seal 40; a forward insert 20; a rear contact retaining insert 10 having towers 15; and a rear moisture sealing grommet 30 generally made from rubber. The forward insert 20 includes a plurality of bores 21 which include an enlarged portion 22 for receiving the tubular tower 15 of the rear insert. The main body 10 of the rear insert includes a rear face 13 and a forward face 12. A portion of the forward face 12 is in contact with a rearward face of the forward insert 20 and the rear face 13 is in contact with a forward face of the moisture sealing grommet 30. The body 10 of the insert and the retention towers 15 include a passage 11 which extends therethrough. Each of the towers 15 is made up of a plurality of resiliently and radially expandable fingers 14 which are arranged to form the tubular tower 15. Internally of each of the resiliently and radially deflectable fingers 14 there is a groove 18, which along with the grooves in other fingers 14, form an annular groove around the inside of the tower 15. On each side of the annular groove 18 surfaces 16 and 17 taper outwardly and away from said groove 18.

Figure 2:
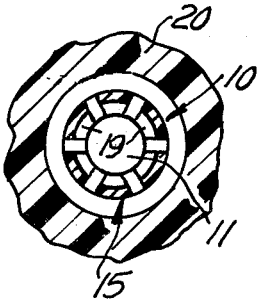
FIG. 2 illustrates a cross-sectional view of a contact retention tower taken along lines II—II in FIG. 1.

FIG. 2 is a view looking into the towers 15 taken along lines II—II of FIG. 1. This view illustrates how the annular groove 18 inside the retention tower 15 includes a forwardly facing shoulder 19. Similarly, but not shown, the annular groove 18 also includes a rearwardly facing shoulder. The forwardly and rearwardly facing shoulders of the groove 18 are adapted to engage the forwardly and rearwardly facing shoulders of a respective contact thereby retaining the contact in the insert 10.

Figure 3:
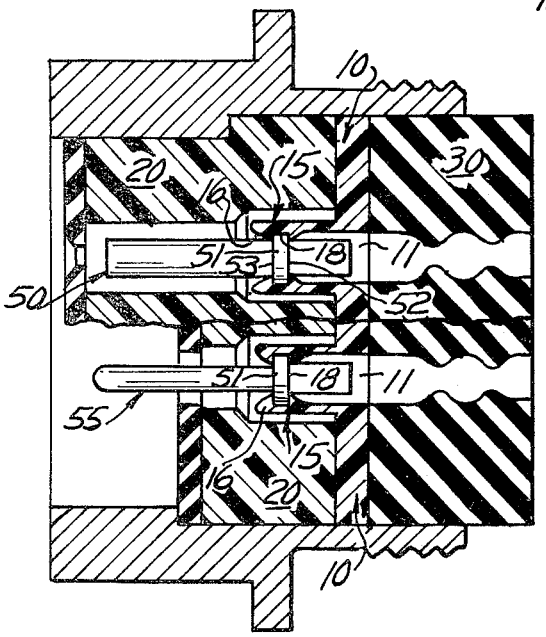
FIG. 3 is a diagrammatic view of an electrical connector assembly incorporating the principles of this invention.

FIG. 3 illustrates a diagrammatic view of an electrical connector assembly having a male contact 55 and a female contact 50 mounted therein. The socket type or female contact 50 is retained by the annular groove 18 in the expandable retention tower 15 which engages the forwardly facing shoulder 53 and rearwardly facing shoulder 52 of the enlarged portion 51 of the socket type contact 50. Similarly, the pin type or male contact 55 is retained by captivating its enlarged portion 51 within the annular groove 18 in the retention tower 15.

Figure 4:
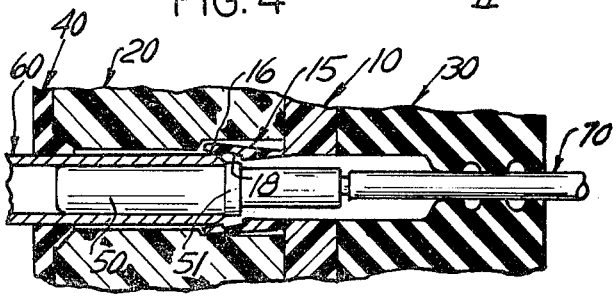
FIG. 4 illustrates how removal of a contact from the connector assembly may be accomplished.

FIG. 4 illustrates how a contact 50 is removed from the connector assembly. To release the contact from the front of the connector an appropriate tubular tool 60 is inserted through the interfacial seal 40 and forward insert 20 until it engages the forwardly tapered surface 16 of the contact retention tower 15. Further rearward movement of the contact removal tool 60 radially expands the tower so that the enlarged portion 51 of the contact 50 is disengaged from the annular groove 18 thereby releasing the contact for removal from the rear of the insert by simply pulling on the wire 70 attached to the contact 50. To release the contact from the rear the same procedure would be followed except that an appropriate tubular tool is inserted through the grommet 30 until it engages the rearwardly tapered surface 17 of the tower 15 and expands the tower 15 to release the contact.

While a preferred embodiment of the invention has been disclosed it will be apparent to those skilled in the art that changes may be made to the invention as set forth in the appended claims and in some instances certain features of the invention may be used to advantage without corresponding use of other features. For instance, the configuration of the forward insert 20 changes somewhat to accommodate the retention of a socket type contact but both arrangements provide for either front or rear release and rear removal of a contact. Accordingly, it is intended that the illustrative and descriptive materials herein be used to illustrate the principles of the invention and not to limit the scope thereof.

Having described the invention what is claimed is:

1. In combination with an electrical connector insert of the type having a body of insulation material having a plurality of passages therethrough from a front face to a rear face and respective electrical contact members therein which are insertable from the rear and which have an enlarged portion defining a rearwardly facing shoulder and a forwardly facing shoulder, the improvement comprising:

a plurality of tubular contact retention towers integral with the body and coaxial with the respective passages therein, each of said towers having an internal annular groove therein that includes a forwardly facing wall and an opposing rearwardly facing wall, the surfaces on opposite sides of said groove tapered radially outwardly, each tower being resiliently radially expandable to permit the enlarged section of a respective contact member to pass into the tower upon insertion of the contact member into a respective passage from the rear of the body, said tower contracting when the enlarged portion of the contact members enters the annular groove, the forwardly and rearwardly facing walls of the groove engaging the forward and rearward shoulders of the enlarged portion of the contact member to limit forward and rearward movement of the contact member in the passage, said tapered surfaces on both sides of said groove adapted to receive an appropriate tool from the rear or the front of said passage to radially expand the towers and disengage the enlarged portion of the contact from the groove, whereby the contact may be released from either the front or rear of the passage for removal from the body.

2. In combination with an electrical connector having rear removable contacts, said connector of the type having: a housing; a plurality of contacts, each contact having a rear portion, a forward mating portion, and an enlarged middle portion having a forwardly facing shoulder and a rearwardly facing shoulder; and means for releasably mounting said contacts in said housing, the improvement wherein the means for releasably mounting said contacts includes:

a rear insert having a plurality of bores each having the rear portion of a respective contact therein the rear insert including a rear base portion and a plurality of tubular contact retention towers, each tower integral with and extending forwardly from said base, coaxial with a respective bore, resiliently and radially expandable and, including on the inside thereof, an annular groove containing the enlarged middle portion of a respective contact, the surfaces on opposite sides of said groove tapering radially outwardly from said groove; and a forward insert having a plurality of bores each having a portion of the forward portion of a respective contact therein and an enlarged portion having a respective tower therein, whereby a tool may be inserted into a bore in the rear insert or into a bore in the front insert to engage and radially expand a tower until the shoulders of the contact are disengaged from the groove in the tower, thereby releasing the contact for removal from the rear of the insert.

3. In combination with an electrical connector having front or rear releasable and rear removable contacts, said connector of the type having: a housing, a plurality of contacts, each contact having a rear portion, a forward mating portion, and an enlarged middle portion having a forwardly facing shoulder and a rearwardly facing shoulder; and means for releasably mounting said contacts in said housing including a rear insert having a plurality of bores each having the rear portion of a respective contact therein, a plurality of resiliently and radially deflectable members extending from the forward portion of each of said bores, and a forward insert having a plurality of bores each having a portion of the forward portion of a respective contact therein, the improvement wherein the means for releasably mounting said contacts includes:

a rear insert having a plurality of bores each having the rear portion of a respective contact therein the rear insert including a rear base portion and a plurality of tubular contact retention towers, each tower integral with and extending forwardly from said base, coaxial with a respective bore, resiliently and radially expandable and, including on the inside thereof, an annular groove containing the enlarged middle portion of a respective contact, the surfaces on opposite sides of said groove tapering radially outwardly from said groove; and a forward insert having a plurality of bores each having a portion of the forward portion of a respective contact therein and an enlarged portion having a respective tower therein, whereby a tool may be inserted into one of said bores in said forward insert and in said rear insert to engage the tapered surfaces of said tower and radially expand said tower until said contact is released, thereby permitting removal of the contact from the rear of the connector.

4. In combination with an electrical connector insert of the type having a body of insulation material having a plurality of passages therethrough from a front face to a rear face and a respective electrical contacts therein which are insertable from the rear and which have an enlarged portion defining a rearwardly facing shoulder and a forwardly facing shoulder, the improvement comprising:

a plurality of contact retention members with the body and coaxial with the respective passages therein, each of said members having an internal annular groove therein, the surfaces on opposite sides of said groove tapered radially outwardly, each member being resiliently radially expandable to permit the enlarged section of a respective contact to pass into the member upon insertion of the contact into a respective passage from the rear of the body, said member contracting when the enlarged portion of the contact enters the annular groove, the walls of the groove engaging the forward and rearward shoulders of the enlarged portion of the contact to limit forward and rearward movement of the contact in the passage, said tapered surfaces on both sides of said groove adapted to receive an appropriate tool from the rear or the front of said passage to radially expand the member, whereby the contact being released from either the front or rear of the passage may be removed from the body.

* * * * *